United States Patent [19]

Hammett

[11] 4,324,505

[45] Apr. 13, 1982

[54] SUBSEA BLOWOUT CONTAINMENT METHOD AND APPARATUS

[76] Inventor: Dillard S. Hammett, 3729 Alta Vista La., Dallas, Tex. 75229

[21] Appl. No.: 73,367

[22] Filed: Sep. 7, 1979

[51] Int. Cl.[3] ..... E02B 3/00; E02D 23/00

[52] U.S. Cl. ..... 405/60; 210/922

[58] Field of Search ..... 405/60, 59, 210; 210/922, 923

[56] References Cited

U.S. PATENT DOCUMENTS

| | | | |
|---|---|---|---|
| 3,599,434 | 8/1971 | Missud | 405/60 |
| 3,643,741 | 2/1972 | Miranda | 405/60 X |
| 3,667,605 | 6/1972 | Zeilinski | 405/60 X |
| 3,681,923 | 8/1972 | Hyde | 405/60 |
| 3,719,048 | 3/1973 | Arne et al. | 405/210 X |
| 3,745,773 | 7/1973 | Cunningham | 405/60 |
| 3,813,887 | 6/1974 | Kruger et al. | 405/188 |
| 3,879,951 | 4/1975 | Mason | 405/60 |
| 3,898,846 | 8/1975 | McCabe | 405/210 |
| 3,981,154 | 9/1976 | Hix | 405/60 |

*Primary Examiner*—Dennis L. Taylor

*Attorney, Agent, or Firm*—Hubbard, Thurman, Turner, Tucker & Glaser

[57] ABSTRACT

Blowout containment apparatus for use in offshore areas comprising an inverted funnel adapted for positioning over a wellhead to receive fluids from the well and direct them into a conduit extending from the funnel to surface support and processing equipment. The funnel and conduit are supported from the sea's surface preferably by a vessel such as a barge. The barge carries the equipment to receive the full flow of fluids from the well, to process the fluids, and to conduct the liquids to a nearby tanker where the recovered liquid hydrocarbons may be stored. The method of blowout containment includes the controlled positioning of the support vessel, from which is suspended the inverted funnel, over the wellhead to capture the fluids erupting from the blowout and receiving the fluids from the upper end of the conduit at a rate at least equal to the flow into the funnel end of the conduit.

15 Claims, 8 Drawing Figures

SUBSEA BLOWOUT CONTAINMENT METHOD AND APPARATUS

BACKGROUND OF THE INVENTION

The present invention relates to the containment or recovery of gases and liquids erupting from a blown out oil well and more particularly to containment apparatus for use in an offshore environment to contain fluids erupting from a wellhead at the sea floor.

As the world wide demand for hydrocarbon fuels has increased, and known onshore reserves have not kept up with the demand, there has been increasing activity in offshore oil exploration and production. Reserves of oil known to exist in the offshore areas have steadily increased and an increasing percentage of world production is from these offshore areas. The offshore environment has presented numerous new challenges to the oil drilling industry which have been steadily overcome to allow efficient drilling and production in these areas although the costs has been considerably higher than that of onshore operations.

Not only has the offshore environment made production more difficult to accomplish, but it has also generally increased the risk of environmental damage in the event of a well blowout or other uncontrolled loss of hydrocarbons into the seas. As a result known safety equipment, such as blowout preventers which have been used successfully in onshore operations, has been used in the offshore operations also. In spite of the safety precautions, blowouts of offshore oil wells are known to occur and will occur again in the future.

While many of the techniques used in on shore operations to fight blowouts can also be applied in the offshore environment, they often prove to be less effective and require a much longer time period for implementation. Thus, for example, while relief wells can be drilled to intercept the blowout well, a great amount of time may be required in the drilling operation. In drilling the relief wells, platforms or other drilling support decks must be located and transported to the blowout site before drilling operations can be begun. Due to the rugged offshore environment, more time is required to drill the relief wells than would be required in an onshore operation. As a result of all of these difficulties, many months can pass between the occurrence of an offshore oil well blowout and the successful final capping of the blown out well. In the intervening time, large quantities of oil and gas can escape into the ocean with serious environmental impact.

While a portion of the hydrocarbons lost from a subsea well blowout may be trapped and skimmed up by various containment booms and oil skimmer ships, substantial quantities of hydrocarbons still escape such containment equipment. It can be seen that once the hydrocarbons are allowed to reach the ocean's surface, wave action tends to disperse the lighter hydrocarbons which may mix with water or evaporate into the air. The gaseous hydrocarbons of course tend to escape into the atmosphere. The heavier ends of the crude oil often form into globules or tarballs which may float at, or just below, the water's surface making it difficult to contain or skim up.

Natural oil seeps are known to occur from the sea floor in various parts of the world. Some of this oil has been recovered by placing heavy domes over the seep location and imbedding the lower edge or skirt of the dome in the sea floor sediments. When properly placed the dome prevents currents from carrying the seepage away and traps the seepage by simple gravity separation of oil and water. A small tubing is normally connected to the peak of the dome to allow occasional removal of collected oil. The dome structures are generally not suitable for containment of wellhead blowouts where large quantities of gas and oil are erupting. The force of such blowouts would tend to lift most domes. The dome shape is also not effective in diverting high speed flow. In the case of most blowouts large amounts of debris, such as drill pipe, casing, etc., fall to the sea floor around the wellhead. This debris makes it impossible to set any type of dome over the well head with any semblance of seal formed between the dome edges and the sea floor.

Thus, it can be seen that upon the occurence a offshore well blowout, it would be desirable to intercept and contain the erupting hydrocarbons as closely as possible to the wellhead and to direct then into processing equipment for separation and storage of the hydrocarbons.

SUMMARY OF THE INVENTION

Accordingly, an object of the present invention is to provide apparatus for containing the flow of fluids from a subsea oil well blowout.

Another object of the present invention is to provide apparatus which may be moved into position to contain the flow of fluids from a subsea well blowout in a fairly short time.

Another object of the present invention is to provide an improved method for recovering substantially all fluids flowing from a subsea well blowout and preventing the mixing of such fluids with large quantities of the seawater.

These and other objects of the present invention are achieved by providing containment apparatus comprising an inverted funnel connected to a lower end of a conduit which extends to the sea surface and means for supporting the conduit and funnel over a subsea well blowout. The funnel guides and directs fluids from the wellhead into the conduit to flow to the surface in a controlled manner where the hydrocarbons can be separated from other fluids and stored for later use or disposal. An improved method of hydrocarbon containment includes the positioning of an inverted funnel over a subsea well blowout and the conducting of hydrocarbons contained by the funnel through a conduit to surface processing and storage equipment.

BRIEF DESCRIPTION OF THE DRAWINGS

The present invention may be better understood by reading the following detailed description of the preferred embodiment with reference to the accompanying drawings wherein.

DESCRIPTION OF THE PREFERRED EMBODIMENTS

Figure 1:
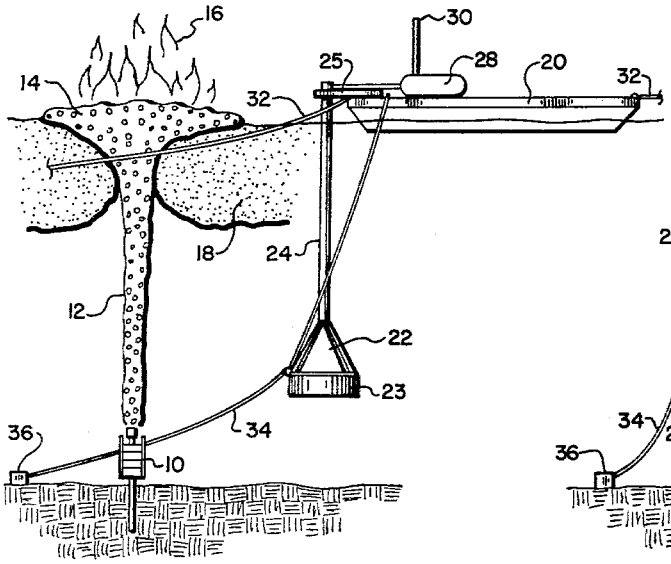
FIG. 1 is an illustration of a subsea well blowout and containment apparatus according to the present invention in position next to the blowout site.
Figure 2:
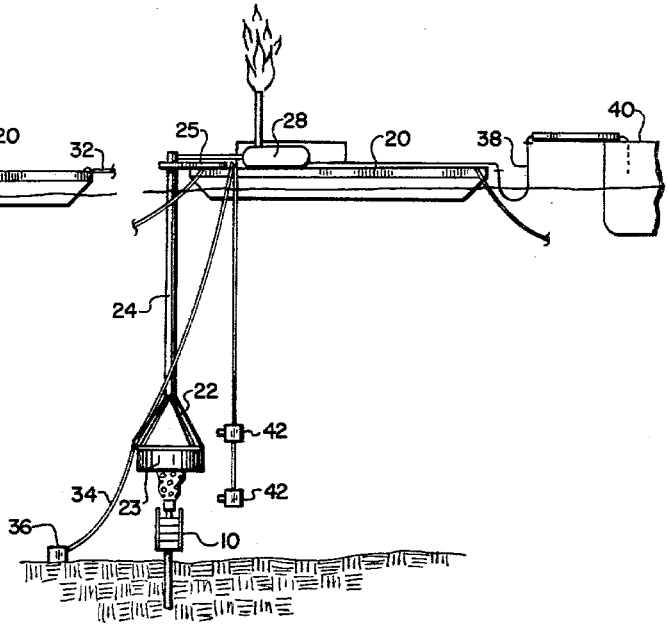
FIG. 2 is an illustration of the equipment in FIG. 1 after it has been moved into position over the subsea blowout to contain the flow of fluids from the wellhead.

With reference now to FIGS. 1 and 2, apparatus according to the present invention and its placement over a blown out subsea wellhead is illustrated. Thus, in FIG. 1, a subsea wellhead 10 is illustrated erupting a flow of hydrocarbon gas and liquids forming a flume 12. This flume 12 expands into a large bubble 14 at the surface and a flame 16 is usually ignited to burn off the gas and volatile hydrocarbons. An emulsion layer 18 usually occurs near the surface containing a mixture of hydrocarbons and water. This layer 18 results both from the fact that considerable quantities of light hydrocarbons occur in the flume 12 and due to the fact that the high pressure escaping fluids generate tremendous turbulence which tends to mix the normally non-miscible hydrocarbons and water. The hydrocarbons in such an emulsion layer are, of course, quite difficult to recover with any normal surface skimming or containment apparatus.

Also illustrated in FIG. 1 is a ocean going barge 20 from which is suspended an inverted funnel 22 and vertical conduit 24. A flexible fabric skirt 23 may be provided on the lower edge of funnel 22 if desired. The funnel 22 is preferably supported from barge 20 or other suitable vessel on the end of a cantilevered beam 25 for reasons which will be apparent. Also illustrated on barge 20 are a gas liquid separator 28 and a flare 30 for burning off hydrocarbon gases. Mooring lines 32 are connected to the barge 20 to provide accurate positioning of the barge relative to the wellhead 10. Lines 32 may be connected to anchors on a sea floor and controlled by winches on barge 20, if desired. However, it is believed to be preferable to control the positioning of barge 20 from at least two other vessels anchored on opposite sides of wellhead 10 with the mooring lines 32 connected to winches on the other vessels. In this way, the positioning of barge 20 is performed remotely with less danger to personnel. Additional mooring lines, such as line 34, may be connected between funnel 22 and subsea anchors 36 or of course, other anchored vessels.

After the barge 20 has been positioned adjacent the wellhead 10 as illustrated in FIG. 1, the containment operation may be commenced. If the gas hydrocarbons are still burning, the flame 20 must be extinguished by conventional means such as high explosives. Once the flame is extinguished, the barge 20 is winched into the position illustrated in FIG. 2 with the funnel 22 positioned directly over wellhead 10. The conical shape of funnel 22 captures the jet flow of fluid from the wellhead and effectively directs it into the conduit 24 where it travels to the surface and into separator 28 on barge 20. Additional lines 38 are provided between barge 20 and a tanker 40 where recovered liquids are further processed and the hydrocarbons may be stored.

As noted above, it may preferable to initially position the barge 20 over the wellhead 10 totally by remote control for obvious safety reasons. Television cameras 42 may be suspended from barge 20 to observe the relative positioning of funnel 22 and wellhead 10, if desired. The cantilevered beam 25 also increases safety of the operation by keeping as much as possible of the vessel 20 out of the large bubble 14 which provides much less buoyancy than normal sea water. The large flat barge 20 is also preferred over the seagoing vessels due to its inherent stability and good buoyancy characteristics. Scale testing has shown that a barge may be positioned directly over the bubble 14 without capsizing or sinking. Once the funnel 22 captures the flow of fluid from the wellhead, the bubble 14 will, of course, dissipate.

The dimensions of the funnel 22 and vertical conduit 24 will, of course, vary according to the flow rate from the wellhead 10 and the water depth. The length of conduit 24 will be selected to position the funnel 22 as closely as possible to the top of wellhead 10. Thus, for a blowout in 165 feet of water, the conduit 24 may be 150 feet long. The diameter of conduit 24 will depend upon the quantity of fluids to be contained. Thus, for a hydrocarbon flow rate of ten to twenty thousand barrels a day with a large quantity of high pressure gas also escaping, a conduit having a diameter of 30 to 36 inches with one inch thick wall, is believed to be adequate. Under such conditions, it is anticipated that from five hundred thousand to seven hundred thousand barrels of water per day may be drawn into the flume of hydrocarbons erupting from well 10 and forced up conduit 24. The funnel 22 itself under such conditions if preferably conical and has a diameter on its larger end of approximately 30 to 40 feet and is fifteen to twenty feet tall from its open end to the point of connection to conduit 24. To facilitate fabrication, funnel 22 may be formed with a square lower end and four flat triangular sides. A full scale model having eight triangular sides is anticipated. As with the conduit 24, it is believed that one inch thick steel plate should be used in construction of the funnel 22 to provide sufficient strength. While as noted above, the length of vertical conduit 24 must be selected for a particular water depth, it can be seen that it is a simple matter to fabricate this vertical conduit from standard steel tubing to any desired length.

Figure 3:
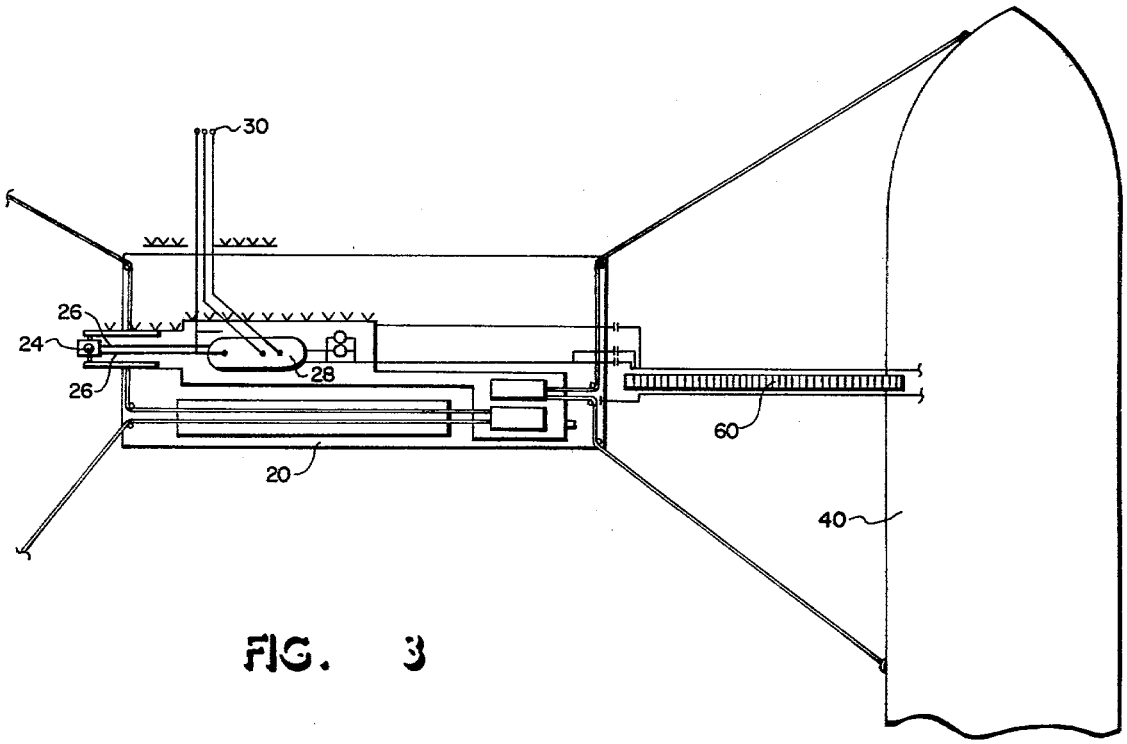
FIG. 3 is a plan view of hydrocarbon containment apparatus according to the present invention supported on a barge and connected to a tanker for storage of fluids.
Figure 4:
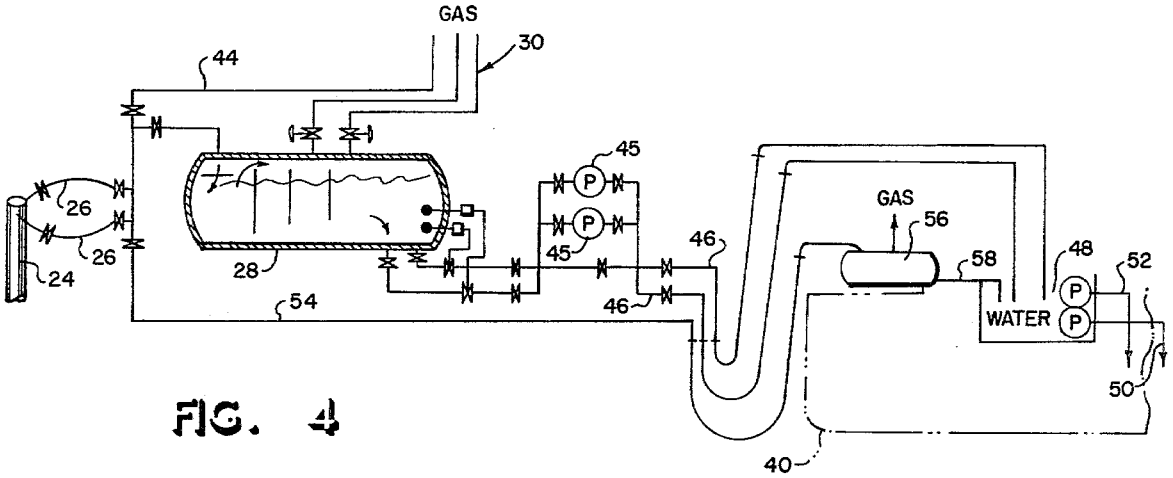
FIG. 4 is schematic illustration of the fluid processing and storage equipmebnt forming part of the hydrocarbon containment apparatus of the present invention.

With reference now to FIGS. 3 and 4, the arrangement of equipment for processing the flow of fluids received through conduit 24 is illustrated in both a plan view of the barge 20 and tanker 40 and in a schematic illustration. It can be seen that it is important to receive and process the fluids flowing up conduit 24 at a rate at least equal to that at which the fluid jet from wellhead 10 drives fluids into cone 22. Thus, scale testing has shown that the velocity and inertia of the jet of fluids erupting from wellhead 10 is sufficient to drive these fluids together with large quantities of water through the conduit 24 to the surface. Additionally, it can be seen that the differential densities of the mixture of hydrocarbons and water in conduit 24 and the surrounding water will tend to lift the fluids in conduit 24 to the surface and provide considerable pressure at the top of conduit 24. But if the conduit is allowed to fill and the flow within the conduit stops, it is quite apparent that the fluids entering funnel 22 will simply flow around the funnel and float to the surface in an uncontrolled manner. To insure a proper flow path from the top of conduit 24, a parallel pair of conduits 26, including various valves for controlling flow rate, are connected to the top of conduit 24. Under normal operations, the fluids in conduits 26 flow directly into a gas liquid separator 28. A pair of gas outlets from separator 28 are connected to the flare 30 for disposing of the hydrocarbon gases. It is also believed desirable to provide a by-pass line 44 to the flare 30 which will extend a considerable distance from the barge 20 to provide an emergency path for the flow of fluids from conduit 24. In the preferred embodiment fluids, including both water and liquid hydrocarbons, are conducted from the separator 28 through lines 46 to an oil/water separator 48 on the tanker 40. Pumps 45 are included in at least one of the lines 46 so that flow from separator 28 may be increased, when needed, to accomodate surges from conduit 24. The water is then dumped back into the sea through a line 50 while the oil is conducted through a line 52 to the storage tanks on tanker 40. Another bypass 54 is provided from the lines 26 at vertical conduit 24 directly to tanker 40. Line 54 is connected to an alternate gas fluid separator 56 which has a fluid outlet 58 connected to the water hydrocarbon separator 48.

In a preferred form, the barge 20 and tanker 40 are linked together by a walk-way 60 which supports fluid lines between the barge and tanker and also provides access to barge 20 by personnel from tanker 40. This interconnection of the barge 20 and tanker 40 may be provided prior to positioning of the barge over the blowout and the entire unit may be winched into position using appropriate mooring lines. With this arrangement, the tanker 40 remains at the site until the well is permanently capped and the liquid hydrocarbons stored in tanker 40 are removed from the site by pumping into a second tanker for transporting to a disposal or utilization point.

Just as it is desirable to winch the barge into position by remote control for safety reasons, it may also be desirable to operate all of the flow controlling valves and pumps on the barge 20 by remote control. Since the flow of fluids from the well is basically uncontrolled, it is desirable to minimize the number of employees working on barge 20 and the number of hours they spend on the barge. As a result, it is anticipated that most of the valves and pumps will be equipped with remote controls which may be operated, for example, from tanker 40.

Figure 5:
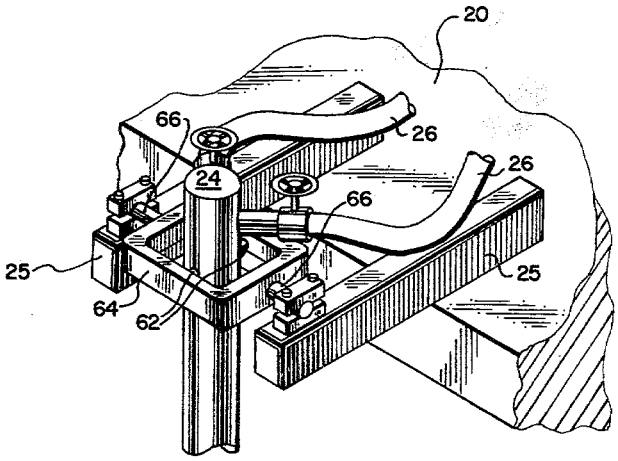
FIG. 5 is a more detailed view of the upper end of a vertical conduit showing its manner of support from a surface vessel.

With reference now to FIG. 5, details of the interconnection of the vertical tube 24 to the barge 20 are illustrated. As noted above, beams 25 are provided cantilevered off an end of barge 20 to position the tube 24 as far as possible away from the center of buoyancy of barge 20. The tube 24 is supported on beams 25 by what amounts to a universal pivot. The universal pivot includes a trunnion 62 journaled in a support box 64. The box 64 in turn carries trunnions 66 which are journaled on the support beams 25. By this arrangement, the vertical conduit 24 may be pivoted in any direction relative to the barge 20 without inducing strain in either of the conduit 24 or barge 20. For this reason, the conduits 26 leading away from conduit 24 are preferably flexible hoses. One reason for this universal pivoting of the conduit 24 is that scale testing of the present invention indicates that the funnel 22 does effectively capture the jet stream of fluid erupting from wellhead 10 as soon as an edge of the funnel is positioned within the stream. That is, as the barge and funnel are moved into position over the wellhead and the edge of the funnel moves into the flow stream, the funnel is pulled into position over the wellhead by the force of the stream itself. The funnel can, therefore, be pulled ahead of the barge 20 as the capturing of the stream occurs. The pivoting of the tube at the support point on the barge prevents any chance of damage during this critical placement operation.

Figure 6:
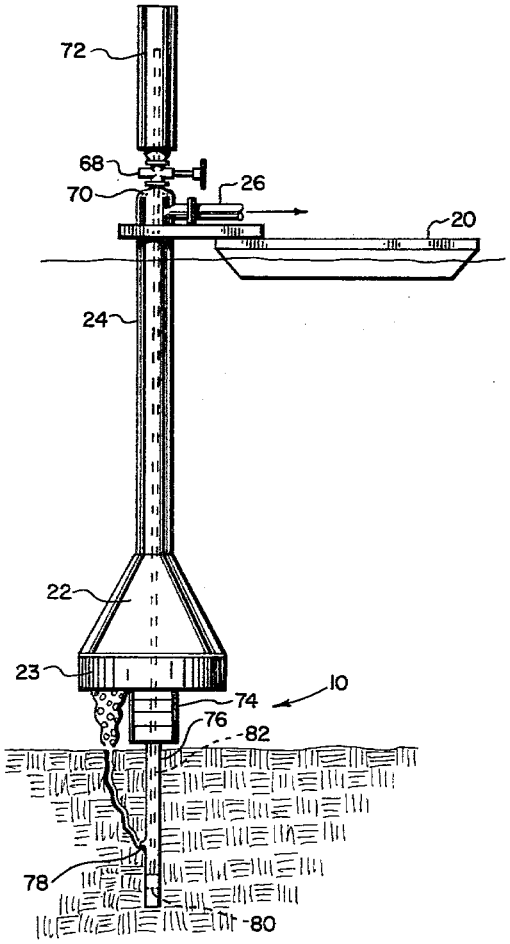
FIG. 6 is an illustration of slightly modified oil containment apparatus according to the present invention including a snubbing unit installed on the upper end of the vertical conduit.

With reference now to FIG. 6, a simplified drawing of another embodiment of the present invention is provided. In FIG. 6, the barge 20, funnel 22 and conduit 24 may be essentially identical to those shown in the other figures. However, in the other figures, the upper end of conduit 24 is solidly capped so that the only communication at the upper end is through the tubes 26. In the FIG. 6 embodiment, an additional element comprising a gate valve 68 is provided in the cap 70 at the top of conduit 24. A snubbing unit 72 is supported on top of conduit 24 and is connected to the gate valve 68. Snubbing unit 72 can be any of the commercially available snubbing units designed for running tubing into a wellhead while maintaining pressurized conditions. Normally the snubbing units can be used only on wellheads which are under control, that is, either shut-in or producing at controlled rates. With the containment apparatus of the present invention and provision of access means on top of the vertical conduit 24, the snubbing unit 72 may be used to run tubing into the wellhead to control or cap the well. In the FIG. 6 embodiment, the wellhead 10 is illustrated as having a blowout preventor 74 in place on the well casing 76. In the event that the blowout preventor 74 is inoperative or a leak 78 has occurred below the blowout preventor, it is necessary to run equipment into the casing to cap the well, for example, by placing a packer 80 below the leak 78. It is anticipated that this arrangement may provide the quickest and simplest method for capping a subsea well blowout.

Figure 7:
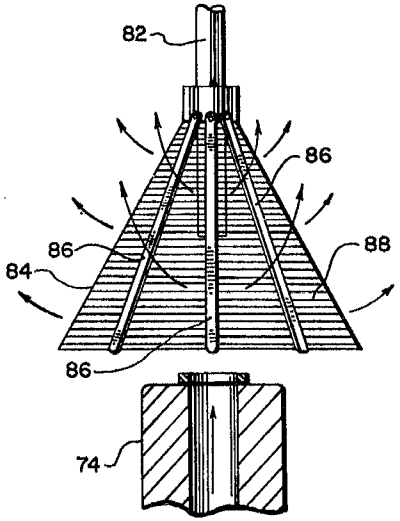
FIG. 7 illustrates a device for use with the snubbing unit of FIG. 6 for guiding tubing into place in the top of the subsea wellhead; and, FIG. 8 is an illustration of a platform support arrangement for the hydrocarbon containment apparatus according to the present invention.
Figure 3:
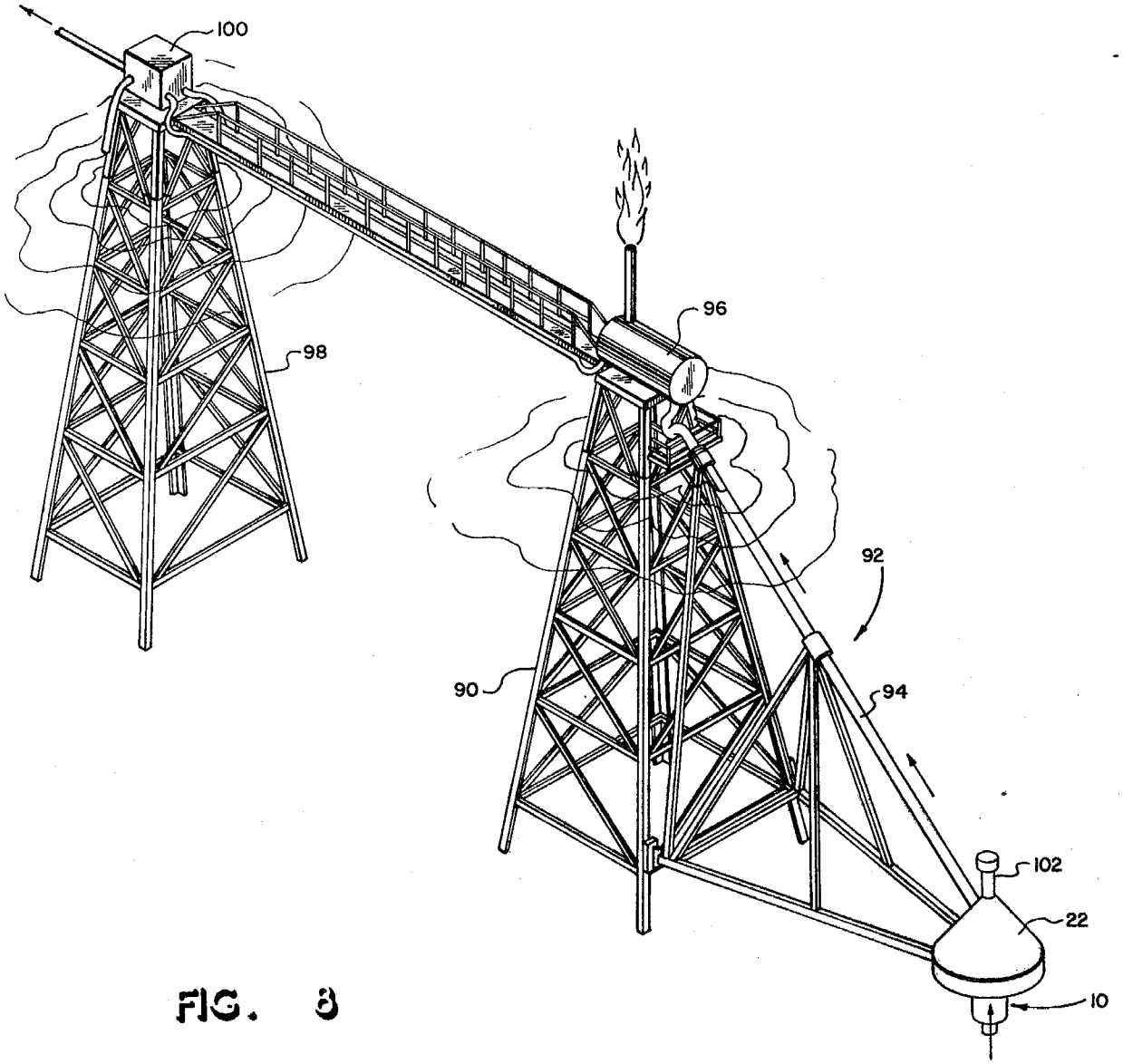

In using the snubbing arrangement shown in FIG. 6, it is, of course, necessary to guide tubing which is run down through the conduit 24 into the blowout preventor 74. With reference to FIG. 7, there is illustrated the lower end 82 of a tubing string as it approaches the blowout preventor 74. A conical guide 84 is attached to the tubing 82 to capture the jet of fluid from wellhead 10 and thereby, direct the tubing 82 into the blowout preventor 74. The conical guide 84 comprises a plurality of arms 86 hinged at their upper end to the tubing string 82. A louvered vent 88 which may comprise a web or mesh of steel fabric is suspended between the arms 86 to complete the conical shape but to allow the fluids to flow through the cone rather than entirely trapping the fluids. The guide 84 may therefore, be folded down into a cylindrical shape which may be passed through the gate valve 68 into the conduit 24 and which will open atomatically when it encounters the fluids flowing up the conduit 24. The conical guide should then direct the tubing 82 directly into the fluid jet the same way that the funnel 22 captures the flume 12 in the initial positioning of the containment funnel.

With reference now to FIG. 8, an alternate arrangement for supporting and placing a funnel 22 over a blown out subsea wellhead is illustrated. In the FIG. 8 embodiment, a platform 90 is supported on the sea floor spaced, for example, two hundred feet from the wellhead 10. The funnel 22 is then positioned on the end of a boom 92 which is hingedly connected to one side of platform tower 90. The boom 92 may be pivoted to bring the funnel 22 into position directly over the wellhead 10. A conduit 94 may be provided as part of boom 92 to conduct fluids from funnel 22 to processing equipment 96 on the platform 90. In a preferred form, the processing equipment 96 would include essentially that illustrated in FIG. 3 as being provided on barge 20. A second platform 98 is then provided at a safer distance from wellhead 10 and carries the oil/water separation equipment and loading arrangements for storing the oil in a tanker which may be anchored to the tower 98. Preferably some means is provided in this FIG. 8 embodiment for mounting a snubbing unit over funnel 22 to allow running tubing into the wellhead 10. A short vertical conduit 102 carrying a gate valve and/or flange on its upper end may be provided. A workover rig including a snubbing unit may then be moved over the funnel 22 and connected to conduit 102. Tubing, carrying for example a packer may then be run through funnel 22 into wellhead 10. The fluids erupting from wellhead 10 may continue flowing through conduit 94 while the tubing is run in and there should be little pressure to be overcome.

As noted above, the blowout containment apparatus of the present invention has been tested on a scale model basis with good results. In these tests, apparatus was scaled down to a ten to one basis. Thus, the funnel was formed with the flat plate arrangement discussed above having a three foot square base, a five inch square top and an overall height of three feet. The vertical conduit had a diameter of approximately three inches. An air jet was provided at the bottom of a test tank with a flow of 16 MM scf/d. A scale model barge with the scale model funnel and riser arrangement was pulled into position over the erupting gas flow and when capture occurred, essentially one hundred percent of the gas erupted through the top of the vertical conduit which was left uncapped in the initial test. The velocity and inertia of the gas jet trapped by the funnel was sufficient to drive fluids from the top of the vertical conduit with considerable force and indicates that pumping will not be required to draw fluids from the vertical conduit. A simulated flow of the gas jet at the rate discussed above with a liquid, alcohol, was also tested. In this test, the recovery of the dyed alcohol was only fifty to seventy percent but it was believed that the alcohol was not fairly representing hydrocarbon oils. As a result, an additional test was run using oil as the test liquid and recovery was increased to eighty percent. In the test using alcohol, it was found that cross currents had a major effect on the recovery rate which was not experienced in tests with oil. A true conical funnel of similar dimensions was also tested for comparison and essentially no differences in recovery rates were detected.

The diameter of the vertical conduit was varied during the tests to determine an optimum diameter. The tests indicated generally that increased diameter of the vertical conduit tended to increase the percentage recovery. Thus the fifty to seventy percent recovery of alcohol increased to about eighty percent when the vertical conduit diameter was increased by about fifty percent.

Thus, the primary results of the scale testing were indications that the funnel would indeed capture a jet of fluids erupting from a blown out wellhead and that the fluids could be conducted to the surface and to recovery equipment with substantial recovery of hydrocarbons. The tests also indicated that it was important to have a sufficiently large diameter vertical conduit to accommodate the fluids erupting from the well to insure maximum recovery.

While the present invention has been illustrated and described with respect to particular apparatus and methods of use, it is apparent that various modifications and changes can be made within the scope of the present invention as defined by the appended claims.

I claim:

1. Apparatus for containment of hydrocarbons flowing from a subsea well blowout comprising:

support means comprising a floating vessel;

an elongated conduit supported by said vessel at an upper end of said conduit;

a funnel having a small end connected to the lower end of said conduit and a large end directed downwardly toward the sea floor;

positioning means for positioning said vessel so that said large end of said funnel is disposed over said well blowout for substantially capturing the flowstream of hydrocarbons emanating from said well blowout;

means forming a connection between said vessel and said conduit to permit limited movement of said conduit and said funnel with respect to said vessel upon capturing at least a portion of said flowstream by said funnel to permit said funnel to be pulled into position over said well blowout by said flowstream; and receiving means connected to said upper end of said conduit and carried by said vessel for receiving hydrocarbons recovered from said well blowout through said funnel and said conduit.

2. Apparatus according to claim 1 wherein said positioning means comprises a plurality of mooring lines coupled to said vessel by winches whereby said vessel may be positioned over a wellhead to thereby position said funnel over said wellhead.

3. Apparatus according to claim 1 wherein said hydrocarbons include both gas and liquid components further including means, carried by said support means, for separating said gas and liquid components and means for flaring said gas components.

4. Apparatus according to claim 1 wherein said hydrocarbons received by said receiving means are mixed with water, further including means for separating said water from said hydrocarbons and means for returning said water to the sea.

5. Apparatus according to claim 1 wherein said receiving means includes an oil tanker and means for conducting recovered liquid hydrocarbons into said tanker for storage.

6. Apparatus according to claim 1 wherein said conduit is essentially vertical, further including valve means carried by the top of said conduit and a snubbing unit supported on said conduit and coupled to said valve means to provide access to the interior of said conduit, whereby tubing may be run through said conduit into a wellhead for repair operations.

7. The apparatus set forth in claim 1 wherein:

said means forming a connection between said vessel and said conduit comprises a universal joint coupling.

8. The apparatus set forth in claim 7 wherein:

said coupling is mounted on a cantilever beam projecting from a side of said vessel.

9. A method for containing a flowstream of hydrocarbons escaping from a subsea well blowout comprising:

suspending a funnel on a fluid conduit from a support means at the sea surface, said support means allowing movement of said conduit and said funnel with respect to said support means;

positioning the funnel over the subsea wellhead whereby at least a portion of said funnel captures a portion of said flowstream so that hydrocarbons from said blowout are directed by said funnel into a lower end of said conduit;

allowing said funnel to be pulled into said flowstream to capture a substantial portion of said flowstream; and receiving hydrocarbons from an upper end of said conduit.

10. A method according to claim 9 wherein fluids received from said conduit include water and gas and liquid hydrocarbons, further including the steps of;

separating the gas hydrocarbons from said water and liquid hydrocarbons, flaring said gas hydrocarbons, separating said water from said liquid hydrocarbons, dumping said water back into the sea, and storing said liquid hydrocarbons.

11. A method according to claim 9 further including:

supporting a snubbing unit on the upper end of said conduit, and running tubing through said conduit and funnel into said wellhead.

12. Apparatus for containment of hydrocarbons flowing from a subsea well blowout comprising:

an elongated conduit;

a funnel connected to the lower end of said conduit, said funnel having a large end directed downwardly toward the sea floor;

support means including a first platform supported on the sea floor and extending to the sea surface, and a boom pivotally connected to said first platform and carrying said funnel on an end opposite said first platform, said boom being operative to pivot said conduit and said funnel into position over a wellhead for capturing a flowstream of hydrocarbons flowing from said wellhead upon placement of said first platform at a predetermined position adjacent to said wellhead;

said conduit being carried on said boom and extending from said funnel to said platform; and said apparatus includes means connected to the small end of said funnel and extending vertically upward for supporting a snubbing unit, whereby tubing may be run into said wellhead through said funnel.

13. The apparatus set forth in claim 12 together with:

a second platform disposed remote from said first platform at a distance from said wellhead greater than said first platform, said second platform including means for separating components of said flowstream emanating from said wellhead.

14. Apparatus for containment of well fluids flowing from an opening in a subsea wellhead, said apparatus comprising in combination:

conduit means including a funnel having a small upper end and a large lower end facing downwardly over said wellhead for capturing well fluids emanating from said wellhead and conducting said well fluids away from said wellhead;

a snubbing unit connected to said conduit means above said funnel and including a valve providing in an open position a passageway into the interior of said conduit means and said funnel; and a guide for a tubing string to be inserted into said wellhead through said valve and the interior of said funnel, said guide comprising a conical shaped member foldable into a collapsed condition for insertion through said valve and said interior of said funnel, said conical shaped member being opened upon entering the interior of said funnel by the action of well fluids impinging on said guide, said guide being operable to center a lower end of said tubing string over said opening in said wellhead in response to well fluids impinging on said guide.

15. The apparatus set forth in claim 14 wherein:

said conical shaped member comprises a plurality of generally downwardly depending arms hingedly connected at their respective upper ends to said tubing string, and a mesh forming a conical shape and suspended between said arms and operable to allow fluids to flow through said guide while providing for the action of well fluids impinging thereon to center the lower end of said tubing string over said opening in said wellhead.

* * * * *